US012565892B2

(12) United States Patent
Ukai et al.

(10) Patent No.: US 12,565,892 B2
(45) Date of Patent: Mar. 3, 2026

(54) HERMETIC TYPE COMPRESSOR

(71) Applicant: FUJITSU GENERAL LIMITED, Kanagawa (JP)

(72) Inventors: Koji Ukai, Kanagawa (JP); Kenshi Ueda, Kanagawa (JP); Naoto Tada, Kanagawa (JP); Ryo Akimoto, Kanagawa (JP); Tatsuya Yasui, Kanagawa (JP); Yudai Morita, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 99 days.

(21) Appl. No.: 18/577,104

(22) PCT Filed: Jun. 30, 2022

(86) PCT No.: PCT/JP2022/026143
§ 371 (c)(1),
(2) Date: Jan. 5, 2024

(87) PCT Pub. No.: WO2023/282163
PCT Pub. Date: Jan. 12, 2023

(65) Prior Publication Data

US 2024/0309871 A1 Sep. 19, 2024

(30) Foreign Application Priority Data

Jul. 6, 2021 (JP) ..... 2021-112422

(51) Int. Cl.
*F04C 29/04* (2006.01)
*F04C 29/12* (2006.01)
(Continued)

(52) U.S. Cl.
CPC ..... *F04C 29/12* (2013.01); *F04C 29/04* (2013.01); *F25B 1/04* (2013.01); *F25B 31/026* (2013.01)

(58) Field of Classification Search
CPC ..... F04C 29/12; F04C 29/04; F04C 2240/30; F04C 18/0215; F04C 2240/804;
(Continued)

(56) References Cited

U.S. PATENT DOCUMENTS

2017/0130721 A1* 5/2017 Morozumi ..... F04C 18/3562
2020/0173439 A1* 6/2020 Ueda ..... F04C 23/008
2023/0067061 A1* 3/2023 Akimoto ..... F04C 23/008

FOREIGN PATENT DOCUMENTS

CN 202117925 U 1/2012
EP 3550224 A1 10/2019
(Continued)

OTHER PUBLICATIONS

Translation of CN 202117925 (Year: 2025).*
Translation of JP 2001132674 (Year: 2025).*

*Primary Examiner* — Kelsey E Cary
(74) *Attorney, Agent, or Firm* — Paratus Law Group, PLLC

(57) ABSTRACT

A hermetic type compressor includes: a compressor main-body container that has a vertically cylindrical shape, and that has a discharge pipe and a suction pipe for a refrigerant; an accumulator container that is connected to the suction pipe; a compression section that is disposed in the compressor main-body container, that compresses the refrigerant sucked from the accumulator container via the suction pipe, and that discharges the compressed refrigerant from the discharge pipe; and a motor that is disposed inside the compressor main-body container, and that drives the compression section. In the hermetic type compressor, the accumulator container includes a cup shape accumulator shell
(Continued)

that has the opening side thereof bonded to the compressor main-body container. The hermetic type compressor further includes: a leg member that is fixed to the outer periphery of the compressor main-body container housing, and that supports the compressor main-body container and the accumulator container; and an elastic body that supports the leg member.

6 Claims, 8 Drawing Sheets

(51) Int. Cl.
*F25B 1/04* (2006.01)
*F25B 31/02* (2006.01)

(58) Field of Classification Search
CPC .... F04C 2270/12; F04C 23/008; F04C 2/344; F25B 1/04; F25B 31/026; F04B 39/121
See application file for complete search history.

(56) References Cited

FOREIGN PATENT DOCUMENTS

| | | | |
|---|---|---|---|
| JP | H03-202682 | A | 9/1991 |
| JP | H06-066258 | A | 3/1994 |
| JP | 2001-132674 | A | 5/2001 |
| JP | 2019-183721 | A | 10/2019 |
| JP | 2020-109283 | A | 7/2020 |

* cited by examiner

HERMETIC TYPE COMPRESSOR

CROSS REFERENCE TO PRIOR APPLICATION

This application is a National Stage Patent Application of PCT International Patent Application No. PCT/JP2022/026143 (filed on Jun. 30, 2022) under 35 U.S.C. § 371, which claims priority to Japanese Patent Application No. 2021-112422 (filed on Jul. 6, 2021), which are all hereby incorporated by reference in their entirety.

FIELD

The present invention relates to a hermetic type compressor that, in a refrigerator or an air conditioner in which a refrigeration cycle is used, compresses a refrigerant and feeds the compressed refrigerant.

BACKGROUND

As far as hermetic type compressors are concerned, a compressor is known in which a compression section and a motor, which drives the compression section, are housed inside a compressor main-body container that is a vertical type having a cylindrical shape, and in which an accumulator container is disposed in the lower part of the compressor main-body compressor for separating a refrigerant into a gas refrigerant and a liquid refrigerant (hereinafter, sometimes referred to as "to separate a gas-liquid two-phase refrigerant") and ensuring that only the gas refrigerant enters into the compression section.

In the compressor disclosed in Patent Literature 1, a rotary-type compression section is used, and the accumulator container that separates a gas-liquid two-phase refrigerant, which is sucked into the compression section, is made of a container independent of the compressor main-body container and is disposed below the compressor main-body container. The compressor main-body container and the accumulator container are connected to each other using a bracket.

In the compressor disclosed in Patent Literature 2, a scrolling-type compression section is used, and the accumulator container is directly bonded to the lower part of the compressor main-body container in which the compression section and the motor, which drives the compression section, are housed.

In the compressor disclosed in Patent Literature 3, the inside of an airtight container is partitioned using a pressured partition wall; the upper part of the pressured partition wall is used as the compressor main-body container in which the compression section and the motor are housed; and the lower part of the pressured partition wall is used as the accumulator container.

CITATION LIST

Patent Literature

[Patent Literature 1] Japanese Laid-open Patent Application No. 2020-109283

[Patent Literature 2] Japanese Laid-open Patent Application No. H3-202682

[Patent Literature 3] Japanese Laid-open Patent Application No. H6-66258

SUMMARY

Technical Problem

As disclosed in Patent Literatures 1, 2, and 3, in a compressor in which the accumulator container is bonded to the bottom part of the compressor main-body container, a structure is being considered in which the accumulator container is directly welded to the compressor main-body container with the aim of holding down the manufacturing cost of the compressor, preventing leakage of the refrigerant from the compressor main-body container into the accumulator container, and achieving a hermetic type compressor having a high degree of reliability. In such a structure too, in order to absorb and suppress the vibrations of the compressor, it is possible to think of a structure, in which a base member is attached to the bottom part in the accumulator container, and an elastic body, which is disposed on the base member, is mounted at the installation position. As a result, the accumulator container and the compressor main-body container are supported by the base member and the elastic body.

However, in this structure, during the operation of the compressor, there are times when the temperature in the accumulator container decreases due to the gas refrigerant present inside, thereby resulting in the freezing of the base member, which is attached to the accumulator shell of the accumulator container. Accompanying the freezing of the base member, the elastic body gets cooled. As a result, the elastic body deteriorates and its elasticity undergoes a decline. Hence, the elastic body, having a declining elasticity, becomes unable to appropriately absorb the vibrations of the compressor and to sufficiently suppress the vibrations.

The disclosed technology is developed in view of the issues explained above, and it is an objective to provide a hermetic type compressor in which the elastic body is prevented from getting cooled due to the low-temperature accumulator shell.

Solution to Problem

According to an aspect of an embodiments in the present application, a hermetic type compressor includes: a compressor main-body container that has a vertically cylindrical shape, and that is provided with a discharge pipe and a suction pipe for a refrigerant; an accumulator container that is connected to the suction pipe; a compression section that is disposed in the compressor main-body container, compresses the refrigerant sucked from the accumulator container via the suction pipe, and discharges compressed refrigerant from the discharge pipe; and a motor that is disposed inside the compressor main-body container, and that drives the compression section, wherein the accumulator container includes a cup shape accumulator shell that has opening side thereof bonded to the compressor main-body container, and the hermetic type compressor further comprises a leg member that is fixed to outer periphery of the compressor main-body container, and that supports the compressor main-body container and the accumulator container, and an elastic body that supports the leg member.

Advantageous Effects of Invention

According to an aspect of the hermetic type compressor according to the application concerned, the elastic body can be prevented from getting cooled due to the low-temperature accumulator shell.

DESCRIPTION OF EMBODIMENTS

An exemplary embodiment of the application concerned is described below in detail with reference to the accompanying drawings. However, a hermetic type compressor according to the application concerned, is not limited by the embodiment described below.

Configuration of Rotary Compressor

Figure 1:
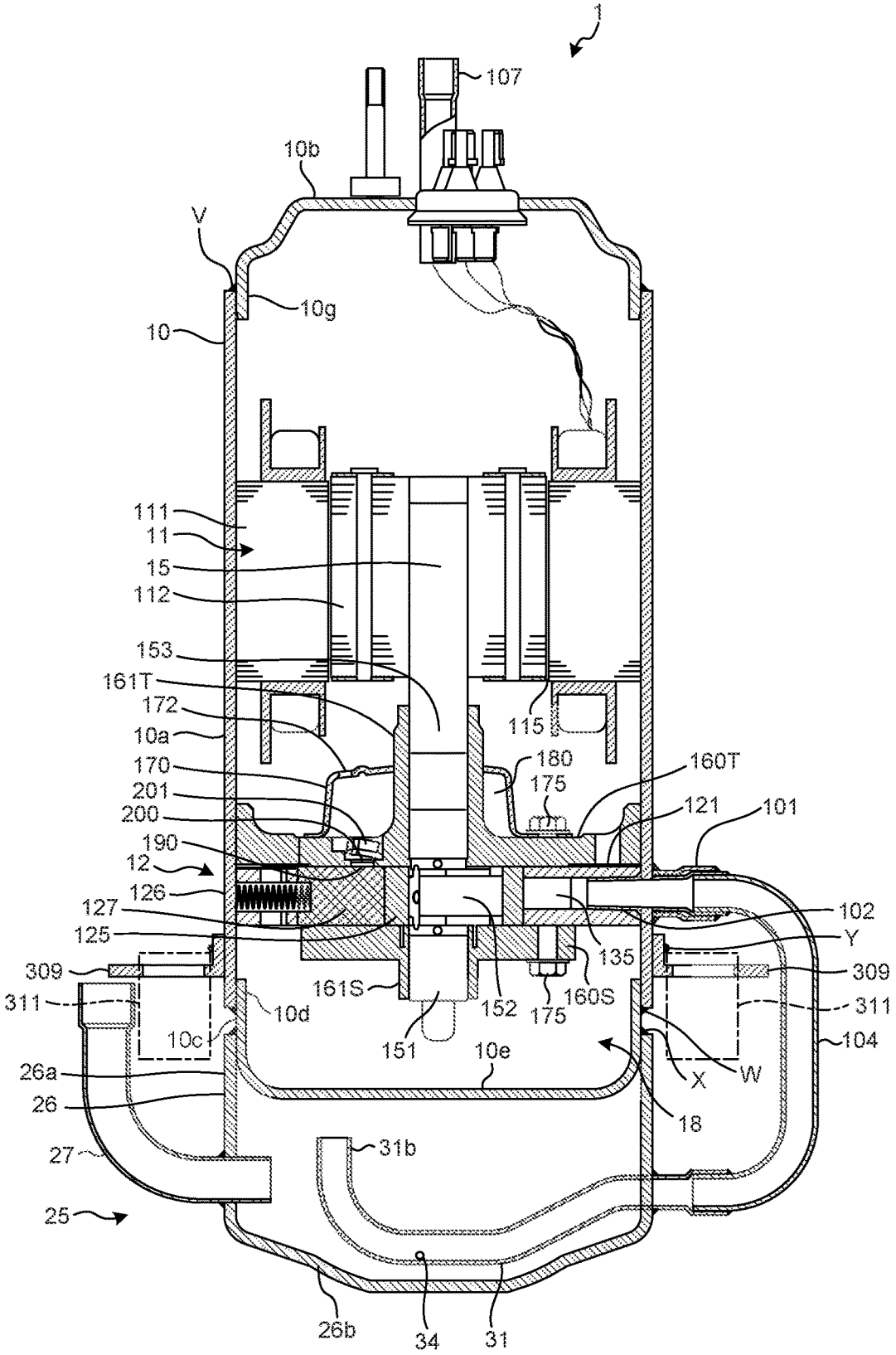
FIG. 1 is a vertical cross-sectional view of a rotary compressor according to an embodiment.
Figure 2:
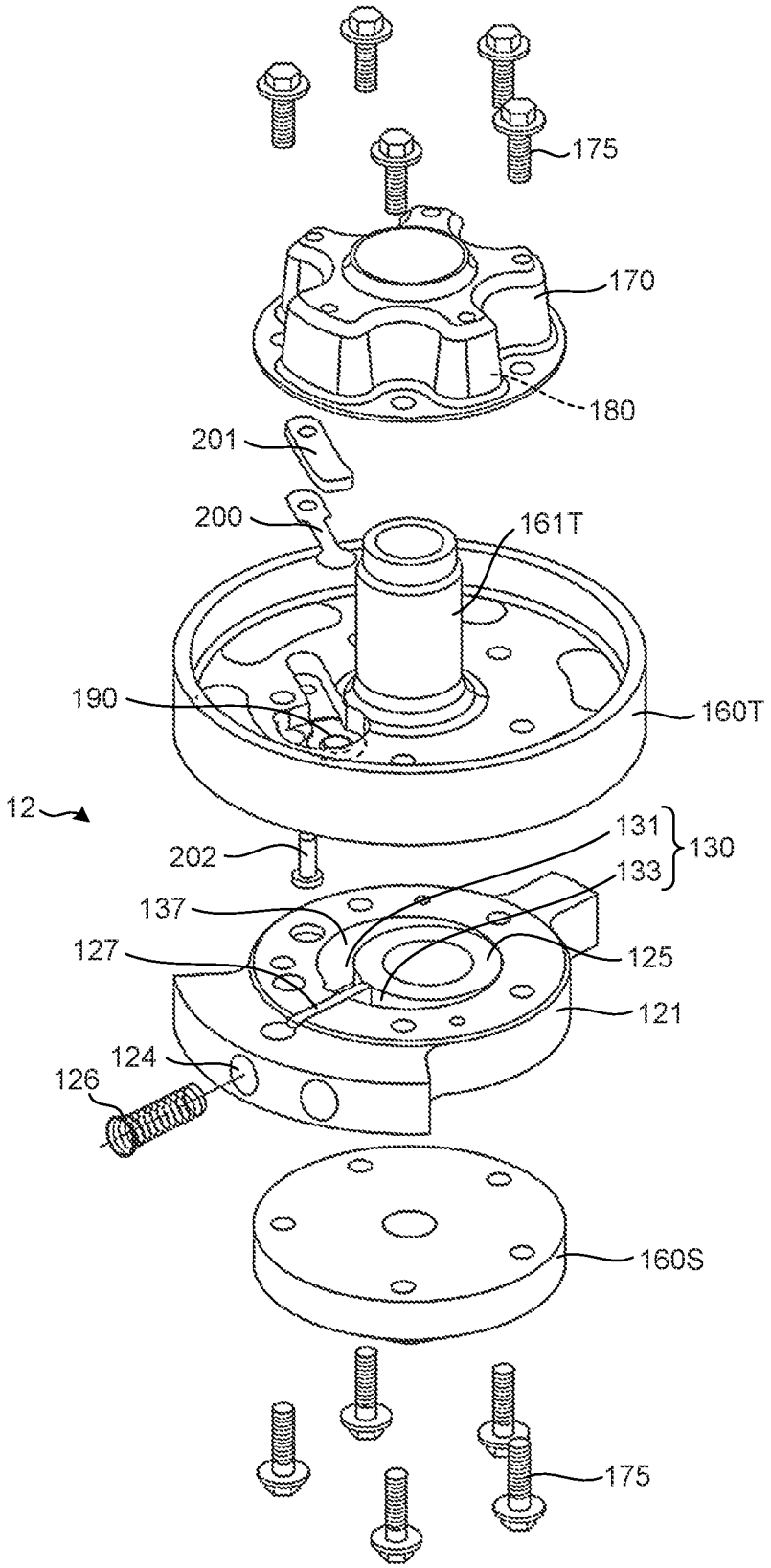
FIG. 2 is an exploded perspective view of a compression section of the rotary compressor according to the embodiment.

In the present embodiment, a rotary compressor is explained as an exemplary compressor. FIG. 1 is a vertical cross-sectional view of the rotary compressor according to the embodiment. FIG. 2 is an exploded perspective view of a compression section of the rotary compressor according to the embodiment.

As illustrated in FIG. 1, a rotary compressor 1 is a hermetic type compressor of the internal high pressure type, and includes: a compressor main-body container 10 used for housing a compression section 12 that sucks a refrigerant from a compression section suction pipe 102 and discharges a compressed refrigerant to the inside of the compressor main-body container 10; and a motor 11 that drives the compression section 12. In the rotary compressor 1, the high-pressure refrigerant, which has been compressed by the compression section 12, is discharged to the inside of the compressor main-body container 10 and is also discharged to a refrigeration cycle via a discharge pipe 107.

The compressor main-body container 10 includes a vertically cylindrical main shell 10*a*, a cup-shaped top shell 10*b*, and a cup-shaped bottom shell 10*c*. To the upper end portion of the main shell 10*a*, an opening side 10*g* of the top shell 10*b* is welded using a first weld portion V. Moreover, to the lower end portion of the main shell 10*a*, an opening side 10*d* of the bottom shell 10*c* is welded using a second weld portion W.

The compression section suction pipe 102, which is used to ensure that a low-pressure refrigerant of the refrigeration cycle enters into the compression section 12, is disposed through the main shell 10*a*. More specifically, a guiding pipe 101 is brazed to the main shell 10*a*, and the compression section suction pipe 102 is brazed to the guiding pipe 101 through the inside of the guiding pipe 101.

The discharge pipe 107 that is meant for discharging the high-pressure refrigerant, which has been compressed in the compression section 12, from the inside of the compressor main-body container 10 to the refrigeration cycle, is disposed through the top shell 10*b*. Herein, the discharge pipe 107 is brazed to the top shell 10*b*.

Below the compressor main-body container 10, an accumulator container 25 is disposed for separating a low pressure gas-liquid two-phase refrigerant, which is sucked from the refrigeration cycle, and ensuring that only the gas refrigerant enters into the compression section 12. More specifically, in the compressor main-body container 10, at a position below the second weld portion W that is used for welding the main shell 10*a* and the bottom shell 10*c*, an opening side 26*a* of a cup-shaped accumulator shell 26 is welded to a non-opening side 10*e* of the bottom shell 10*c* using a third weld portion X. Thus, the inside of the accumulator shell 26 gets hermetically sealed. That results in the formation of the accumulator container 25.

In the accumulator shell 26, an accumulator suction pipe 27, which is used to ensure that the refrigerant enters into the accumulator container 25 from the refrigeration cycle, and a gas-liquid separation pipe 31, which is used to deliver the gas refrigerant from the inside of the accumulator, pass through the accumulator shell 26 and are brazed thereto.

The gas-liquid separation pipe 31 is connected to the compression section suction pipe 102 via a connecting pipe 104 and on the outside of the accumulator container 25.

In the lower part of the accumulator shell 26, a base member 310 is welded for supporting the entire compressor.

The compression section 12 includes a cylinder 121, an upper end plate 160T, a lower end plate 160S, and a rotation shaft 15. The upper end plate 160T, the cylinder 121, and the lower end plate 160S are laminated in that order, and are fixed using a plurality of bolts 175. The upper end plate 160T has a main bearing 161T disposed thereon. The lower end plate 160S has a secondary bearing 161S disposed thereon. The rotation shaft 15 has a main bearing 153, an eccentric portion 152, and a secondary bearing 151 disposed thereon. The main bearing 153 of the rotation shaft 15 engages with the main bearing 161T of the upper end plate 160T, and the secondary bearing 151 of the rotation shaft 15 engages with the secondary bearing 161S of the lower end plate 160S. As a result, the rotation shaft 15 gets supported in a rotatable manner.

The motor 11 includes a stator 111 disposed on the outside, and a rotor 112 disposed on the inside. The stator 111 is shrinkage-fit to the inner periphery of the main shell 10*a*. The rotor 112 is shrinkage-fit to the rotation shaft 15.

The compressor main-body container 10 is internally filled with such an amount of a lubricant oil 18 that the compression section 12 is almost immersed in the lubricant oil 18. The lubricant oil 18 provides lubrication for the sliding members of the compression section 12, and acts as a seal between the high-pressure section and the low-pressure section inside the compression space.

With reference to FIG. 2, given below is the detailed explanation of the compression section 12.

Inside the cylinder 121, a cylindrical hollow portion 130 is provided with a piston 125 disposed therein. The piston 125 engages with the eccentric portion 152 of the rotation shaft 15. On the cylinder 121, a groove is formed in the outward direction from the hollow portion 130, and a vane 127 is disposed in the groove. Moreover, on the cylinder 121, a spring hole 124 is formed from the outer periphery up to the groove, and a spring 126 is disposed in the spring hole 124. One end of the vane 127 is pressed against the piston 125 using the spring 126. As a result, in the hollow portion 130 of the cylinder 121, the space on the outside of the piston 125 gets partitioned into a suction chamber 133 and a discharge chamber 131. In the cylinder 121, an suction hole 135, which is communicated with the suction chamber 133 from the outer periphery, is formed. To the suction hole 135 is connected the compression section suction pipe 102. On the upper end plate 160T, a discharge hole 190, which passes through the upper end plate 160T and gets communicated with the discharge chamber 131, is formed. On the upper end plate 160T, a discharge valve 200, which is used to open and close the discharge hole 190, and a discharge valve guard 201, which regulates the warpage of the discharge valve 200, are fixed using a rivet 202. On the upper side of the upper end plate 160T, an upper end plate cover 170 is disposed to cover the discharge hole 190, and an upper-end-plate cover chamber 180, which is closed due to the upper end plate 160T and the upper end plate cover 170, is formed. The upper end plate cover 170 is fixed to the upper end plate 160T by a plurality of bolts 175 also used to fix the upper end plate 160T and the cylinder 121. On the upper end plate cover 170, an upper-end-plate cover discharge hole 172, which is communicated with the inside part of the upper-end-plate cover chamber 180 and the compressor main-body container 10, is formed.

In the following, a flow of a refrigerant, which is sucked in by a rotation of the rotation shaft 15, will be described.

Due to the rotation of the rotation shaft 15, the piston 125, which is engaged with the eccentric portion 152 of the rotation shaft 15, performs orbital motion, and the refrigerant enters into the suction chamber 133 while the volume of the suction chamber 133 expands. As far as the intake route of the refrigerant is concerned, the low-pressure refrigerant of the refrigeration cycle is sucked into the accumulator container 25 through the accumulator suction pipe 27; and, if the refrigerant, which has entered into the accumulator container 25, is mixed with any liquid, then that liquid accumulates in the lower part of the accumulator container 25 and only the gas refrigerant enters into the gas-liquid separation pipe 31, which has an opening above the inside of the accumulator container 25. Upon entering into the gas-liquid separation pipe 31, the gas refrigerant passes through the connecting pipe 104 and the compression section suction pipe 102 and enters into the suction chamber 133. If the refrigerant, sucked from the refrigeration cycle, contains the liquid refrigerant in a higher amount, then there is a possibility that the liquid level of the liquid refrigerant inside the accumulator container 25 increases above an opening end 31*b* of the gas-liquid separation pipe 31 and a large amount of liquid refrigerant flows into the gas-liquid separation pipe 31. If a large amount of liquid refrigerant flows into the compression section 12 via the gas-liquid separation pipe 31, then it results in damaging the compression section 12. In order to prevent a large amount of liquid refrigerant from flowing into the gas-liquid separation pipe 31, a liquid returning hole 34 is formed on the gas-liquid separation pipe 31 for ensuring that only a small amount of liquid refrigerant enters into the gas-liquid separation pipe 31 in each instance.

In the following, a flow of a refrigerant, which is discharged by a rotation of the rotation shaft 15, will be described.

Due to the rotation of the rotation shaft 15, the piston 125, which is engaged to the eccentric portion 152 of the rotation shaft 15, performs orbital motion, and the refrigerant gets compressed in the discharge chamber 131 while the volume of the discharge chamber 131 decreases. When the pressure of the compressed refrigerant exceeds the pressure in the upper-end-plate cover chamber 180 on the outside of the discharge valve 200, the discharge valve 200 opens up so that the refrigerant is discharged from the discharge chamber 131 into the upper-end-plate cover chamber 180. The refrigerant, which is discharged into the upper-end-plate cover chamber 180, is then discharged through the upper-end-plate cover discharge hole 172, which is formed on the upper end plate cover 170, into the compressor main-body container 10.

The refrigerant, which is discharged into the compressor main-body container 10, is guided above the motor 11 either through a notch (not illustrated) that is formed on the outer periphery of the stator 111 and that is communicated with the upper and lower sides, or through the gap of a winding wire of the stator 111 (not illustrated), or through a gap 115 (see FIG. 1) present between the stator 111 and the rotor 112; and is discharged from the discharge pipe 107, which is disposed in the top shell 10*b*, into the refrigeration cycle.

In the following, a flow of the lubricant oil 18 will be described.

The lubricant oil 18, which is filled in the lower part inside the compressor main-body container 10, is supplied to the compression section 12 through the inside of the rotation shaft (not illustrated) due to the centrifugal force of the rotation shaft. The lubricant oil 18, which is supplied to the compression section 12, gets mixed with the refrigerant, turns into fog, and is carried into the compressor main-body container 10 along with the refrigerant. Then, the lubricant oil 18, which is carried in the form of fog into the compressor main-body container 10, gets separated from the refrigerant due to the centrifugal force attributed to the torque of the motor 11, turns into oil droplets, and returns to the lower part inside the compressor main-body container 10. However, some of the lubricant oil 18 is not separated, and is further carried to the refrigeration cycle along with the refrigerant. The lubricant oil 18, which has been carried to the refrigeration cycle, circulates in the refrigeration cycle, returns to the accumulator container 25, gets separated inside the accumulator container 25, and accumulates in the lower part inside the accumulator container 25. After getting accumulated in the lower part inside the accumulator container 25, the lubricant oil 18 passes through the liquid returning hole 34 along with the liquid refrigerant, enters the gas-liquid separation pipe 31 little by little, and enters the suction chamber 133 along with the sucked refrigerant.

Characteristic Configuration of Rotary Compressor

Figure 3:
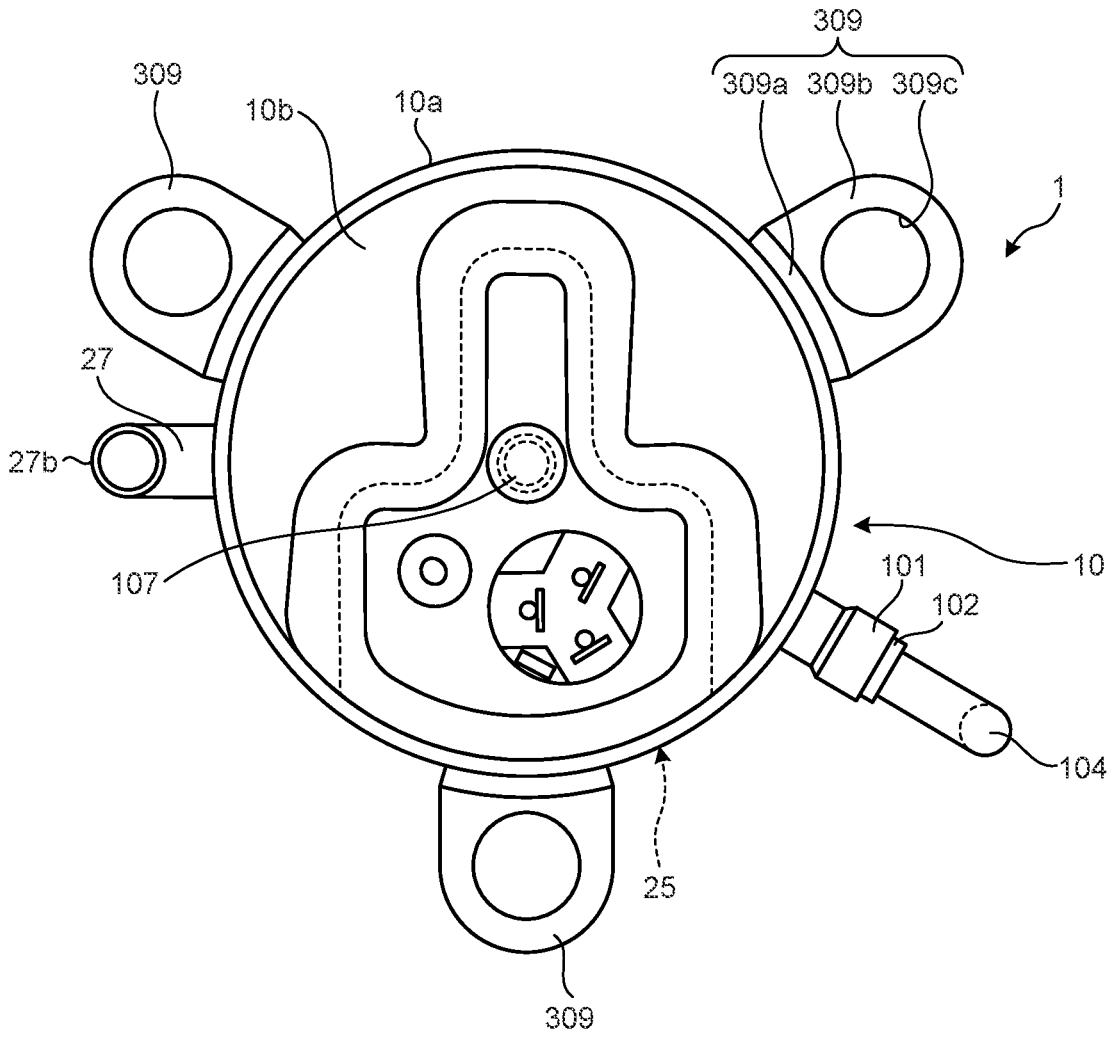
FIG. 3 is a planar view of the rotary compressor according to the embodiment.
Figure 4:
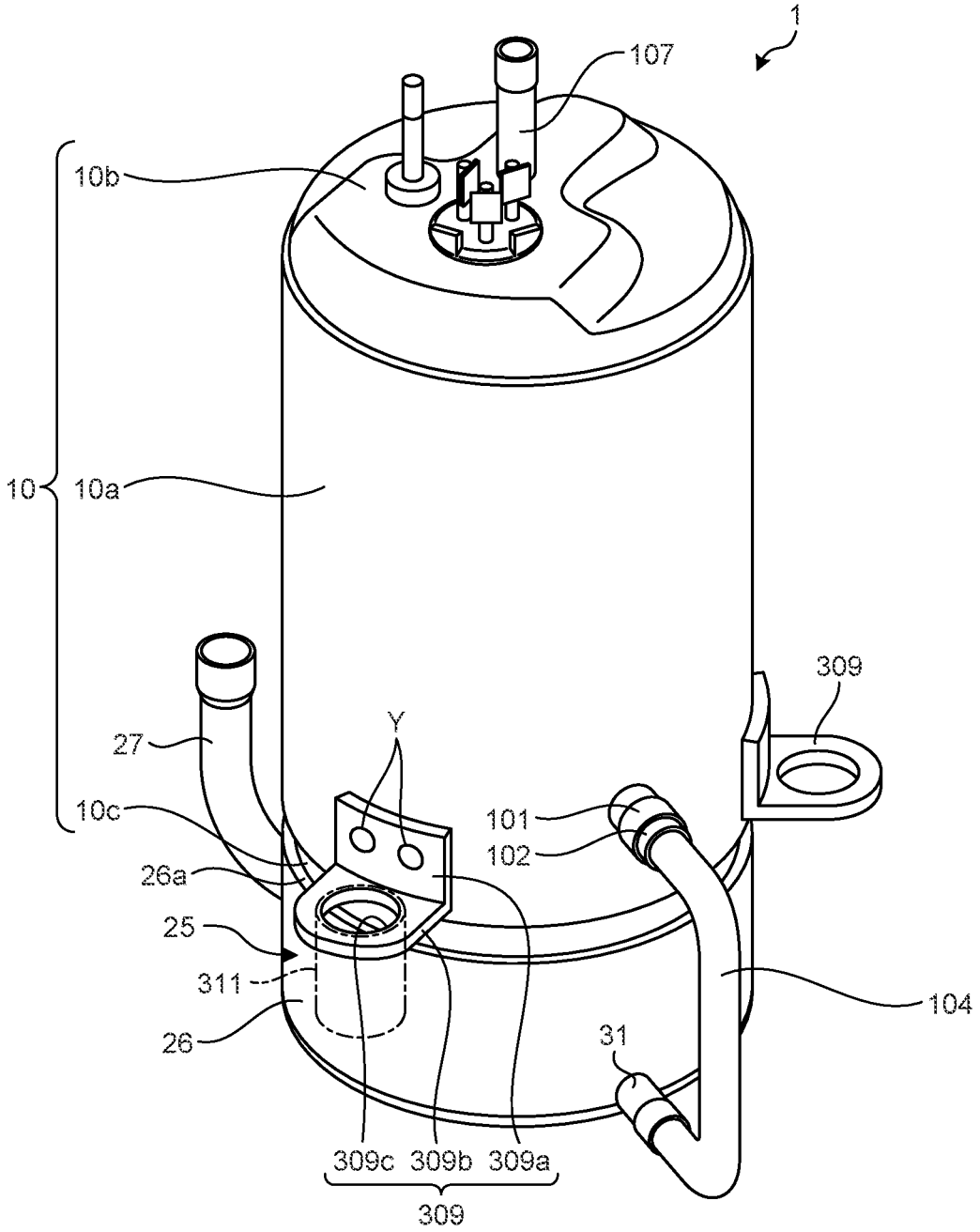
FIG. 4 is a perspective view of the rotary compressor according to the embodiment.
Figure 5:
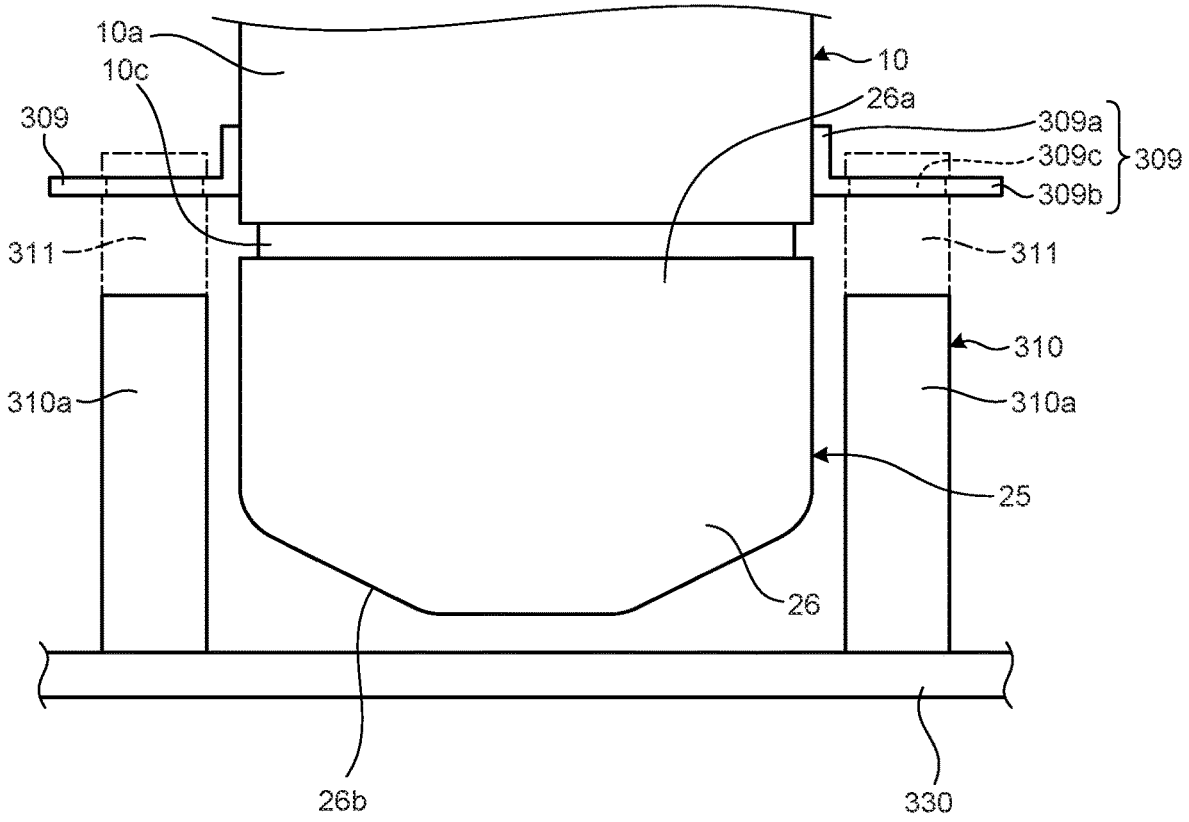
FIG. 5 is a side view of the state, in which the rotary compressor according to the embodiment is supported by leg members and elastic bodies.

In the following, a characteristic configuration of the rotary compressor 1 according to the embodiment, will be described. The features according to the present embodiment include the support structure of the rotary compressor 1, which includes leg members 309 and elastic bodies 311 as illustrated in FIG. 1. FIG. 3 is a planar view of the rotary compressor according to the embodiment. FIG. 4 is a perspective view of the rotary compressor according to the embodiment. FIG. 5 is a side view of the state, in which the rotary compressor 1 according to the embodiment is supported by the leg members 309 and the elastic bodies 311.

As illustrated in FIGS. 1, 3, and 4, the rotary compressor 1 includes three leg members 309, which support the compressor main-body container 10 and the accumulator container 25. The leg members 309 are formed by bending metal plates in the L shape. In the main shell 10*a* of the compressor main-body container 10, on the outer periphery of the lower end portion on the side of the bottom shell 10*c*, each leg member 309 is bonded using a fourth weld portion Y. Hence, the leg members 309, which are bonded to the outer periphery of the main shell 10*a*, are fixed to the outer periphery of the compressor main-body container 10.

Meanwhile, the hermetic type compressor according to the application concerned is not limited to have the structure, in which the leg members 309 are bonded to the main shell of the compressor main-body container 10. Alternatively, although not illustrated in the drawings, the leg members 309 can be bonded to the outer periphery on the side of the opening side 26*a* of the accumulator shell 26 using the fourth weld portions Y. As explained earlier, the opening side 26*a* of the accumulator shell 26 is bonded to the outer periphery of the peripheral wall of the non-opening side 10*e* of the bottom shell 10*c* of the compressor main-body container 10. Thus, the leg members 309, which are bonded to the outer periphery of the opening side 26*a* of the accumulator shell 26, are fixed to the outer periphery of the compressor main-body container 10. In other words, in the application concerned, the structure, in which the leg members 309 are fixed to the outer periphery of the compressor main-body container 10, includes the structure, in which the leg members 309 are bonded to the outer periphery of the opening side 26*a* of the accumulator shell 26, and the structure, in which the leg members 309 are bonded to the outer periphery of the main shell 10*a* of the compressor main-body container 10 or bonded to the outer periphery of the bottom shell 10*c*.

As illustrated in FIGS. 3 and 4, each leg member 309 is formed to have an L-shaped cross-sectional shape; and includes a fixed piece 309*a* that functions as a fixed member, which is fixed to the main shell 10*a* of the compressor main-body container 10, and includes a supporting piece 309*b* that functions as a supporting member, to which an elastic body 311 is attached. The fixed piece 309*a* of the leg member 309 extends along the up-down direction of the main shell 10*a* representing the vertical direction, and is bonded to the outer periphery of the lower end portion of the main shell 10*a* using the fourth weld portion Y. On the supporting piece 309*b*, a mounting hole 309*c*, which extends along a radial direction of the main shell 10*a* representing the horizontal direction and which has the elastic body 311 fit therein, is formed. The elastic body 311, which is attached to the supporting piece 309*b* of the leg member 309, is placed away from the main shell 10*a* at a position more on the outside of the outer periphery of the main shell 10*a* in a radial direction of the main shell 10*a*. Thus, the elastic body 311 is placed away to not make contact with the accumulator shell 26. The elastic body 311, which is attached to the supporting piece 309*b*, is supported from below by the base member 310 explained later.

As a result of being placed away from the outer periphery of the main shell 10*a*, the elastic body 311 is placed at a distance from the accumulator container 25 that is bonded to the main shell 10*a*. Hence, the elastic body 311 does not make contact with the outer periphery of the accumulator shell 26. With that, the frost, which is generated around the accumulator container 25, can be prevented from directly adhering to the elastic body 311, thereby enabling holding down freezing of the elastic body 311.

As a result of getting bonded to the main shell 10*a* of the compressor main-body container 10, the leg member 309 is positioned away from the low-temperature accumulator shell 26, and is placed in contact with the high-temperature main shell 10*a*. For that reason, as compared to the structure in which the leg member 309 is fixed to the side of the accumulator shell 26, the leg member 309 is not easily cooled by the accumulator container 25 inside which the temperature becomes low because of the gas refrigerant. Thus, it becomes possible to effectively hold down freezing of the leg member 309. Consequently, it becomes possible to hold down cooling of the elastic body 311 via the leg member 309 due to the low-temperature accumulator shell 26. That enables holding down a decline in the elasticity of the elastic body 311. Hence, the vibrations of the rotary compressor 1 can be stably absorbed by the elastic body 311 thereby enabling suppression of the vibrations.

Meanwhile, as illustrated in FIG. 3, the three leg members 309 are placed in an equidistant manner in the circumferential direction of the main shell 10*a* of the compressor main-body container 10. As a result, using a simple structure in which the three leg members 309 are used, the entire rotary compressor 1 is stably supported, and the vibrations thereof are suppressed on account of being absorbed by the elastic bodies 311. However, the number of the leg members 309 and the shape thereof, is not limited to the present embodiment.

The rotary compressor 1 according to the embodiment includes the leg members 309, which are made of a metal, and the elastic bodies 311, which are made of rubber. However, there is no restriction on the material of the leg members 309 and the elastic bodies 311. For example, at least some portion of the leg members 309 can be made of a resin material having low heat conductivity.

As illustrated in FIG. 5, the rotary compressor 1 includes the base member 310, which is mounted at the attachment position of the rotary compressor 1. The supporting piece 309*b* of each leg member 309 is supported by the base member 310 via the corresponding elastic body 311. The base member 310 is made of, for example, a metallic material and includes columnar supporting portions 310*a*, which support the elastic bodies 311 attached to the leg members 309. Meanwhile, the rotary compressor 1 is not limited to include the base member 310. Alternatively, the elastic bodies 311 disposed on the leg members 309, can be directly mounted at the respective installation positions.

In the upper end portion of each supporting portion 310*a*, a fixation screw (not illustrated) is screwed after being passed through the corresponding elastic body 311, and thus the elastic body 311 is fixed. The lower end portion of each supporting portion 310*a* is screwed to a bottom plate 330 of an exterior unit. The base member 310 supports the leg members 309 via the elastic bodies 311, and thus supports the compressor main-body container 10 and the accumulator shell 26. The base member 310 gives the support in such a way that an opposite side 26*b* (hereinafter, referred to as the non-opening side of the accumulator shell 26), which is opposite to the opening side 26*a* of the accumulator shell 26, does not make contact with the bottom plate 330, and the vibrations of the rotary compressor 1 are suppressed on account of being absorbed by the elastic bodies 311.

Meanwhile, although not illustrated in the drawings, the leg members 309 can be configured in an integrated manner with the base member 310.

Moreover, in the present embodiment, the leg members 309 are bonded to the outer periphery of the main shell 10*a* of the compressor main-body container 10 using the fourth weld portions Y. Alternatively, although not illustrated in the drawings, the leg members 309 can be bonded to the bottom shell 10*c* of the compressor main-body container 10. From the perspective of avoiding the cooling of the leg members 309 due to the accumulator shell 26 inside which the temperature becomes low, it is desirable to have a structure in which the leg members 309 are bonded to the compressor main-body container 10 inside which the temperature is high. Meanwhile, although not illustrated in the drawings, the leg members 309 can be bonded across the main shell 10*a* of the compressor main-body container 10 and the opening side 26*a* of the accumulator shell 26 using the fourth weld portions Y. With that, the mechanical strength of the coupling state between the main shell 10*a* of the compressor main-body container 10 and the accumulator shell 26, can be supplemented using the leg members 309.

Moreover, when the leg members 309 are bonded to the compressor main-body container 10, the bonding positions of the leg members 309 can be below the lower end portion of the main shell 10*a*. However, from the perspective of avoiding an increase in the size of the leg members 309 and the base member 310, and from the perspective of stably supporting the lower side of the rotary compressor 1 in the up-down direction by the leg members 309 and the elastic bodies 311, it is desirable to have a structure in which the leg members 309 are bonded to the lower end portion of the main shell 10*a* or the bottom shell 10*c* of the compressor main-body container 10, or are bonded to the opening side 26*a* of the accumulator shell 26.

Meanwhile, although explained later in detail (second modification example), inside the accumulator shell 26, at a neighboring position of the bottom shell 10*c* of the compressor main-body container 10, a heat insulation portion can be provided that has a hollow internal space. The heat insulation portion includes, for example, a partitioning member that partitions the inside of the accumulator shell 26, and the internal space is formed as a result of being covered by the partitioning member, the bottom shell 10*c* of the compressor main-body container 10, and the opening side 26*a* of the accumulator shell 26. In that case, for example, the leg members 309 are bonded to such positions on the opening side 26*a* of the accumulator shell 26 that are facing the heat insulation portion. As a result of having such a structure including the heat insulation portion, it becomes possible to avoid the heat transfer between the lower end portion of the main shell 10*a* of the compressor main-body container 10 or the leg members 309, which are bonded to the opening side 26*a* of the accumulator shell 26, and the accumulator shell 26. That makes it possible to further hold down the cooling of the leg members 309 due to the accumulator shell 26. Meanwhile, in the internal space of the heat insulation portion, the level of heat insulation can be further enhanced by providing a heat insulation material.

Effects of Embodiment

As explained above, the rotary compressor 1 according to the embodiment includes: the accumulator container 25 in which the opening side 26*a* of the accumulator shell 26 is bonded to the compressor main-body container 10; the leg members 309 that are fixed to the outer periphery of the compressor main-body container 10 and that support the compressor main-body container 10 and the accumulator container 25; and the elastic bodies 311 that support the leg members 309. As a result, the leg members 309 are placed close to the compressor main-body container 10 inside which the temperature becomes high. Hence, the leg members 309 are not easily cooled by the accumulator shell 26 in which the temperature becomes low due to the refrigerant gas. That enables prevention of the leg members 309 from freezing. Accordingly, it becomes possible to hold down the cooling of the elastic bodies 311 by the low-temperature accumulator container 25, and hence to hold down a decline in the elasticity of the elastic bodies 311. As a result, the vibrations of the rotary compressor 1 can be stably absorbed by the elastic bodies 311, thereby enabling suppression of the vibrations.

In the rotary compressor 1 according to the embodiment, the bottom shell 10*c* of the compressor main-body container 10 is inserted into the opening side 26*a* of the accumulator shell 26; and the opening side 26*a* of the accumulator shell 26 is bonded to the bottom shell 10*c* of the compressor main-body container 10. As a result, the existing compressor main-body container 10 can be used and the bottom shell 10*c* thereof becomes easily applicable by inserting it into the opening side 26*a* of the accumulator shell 26. That enables eliminating an attachment member such as an attachment band for attaching the accumulator container 25 to the compressor main-body container 10, thereby enabling holding down an increase in the manufacturing cost. Moreover, as compared to a structure in which the accumulator container 25 is indirectly coupled to the bottom shell 10*c* of the compressor main-body container 10 via a different member, it becomes possible to avoid the noise and the vibrations attributed to the natural frequency of that different member.

Moreover, the rotary compressor 1 according to the embodiment includes the three leg members 309, which are placed in an equidistant manner in the circumferential direction of the compressor main-body container 10. As a result, in a simple structure in which the three leg members 309 are used, the entire rotary compressor 1 is stably supported, and the vibrations of the rotary compressor 1 can be suppressed using the elastic bodies 311.

In the rotary compressor 1 according to the embodiment, when the leg members 309 are bonded to the compressor main-body container 10, as compared to a structure in which the leg members 309 are bonded to the opening side 26*a* of the accumulator shell 26, not only the leg members 309 are placed away from the low-temperature accumulator shell 26 but they also make contact with the high-temperature main shell 10*a*. As a result, it becomes further difficult for the leg members 309 to get cooled by the accumulator shell 26. That further enables holding down a decline in the elasticity of the elastic bodies 311.

Explained below with reference to the drawings are first and second modification examples. In the first and second modification examples, the constituent elements identical to the embodiment are referred to by the same reference numerals.

First Modification Example

Figure 6:
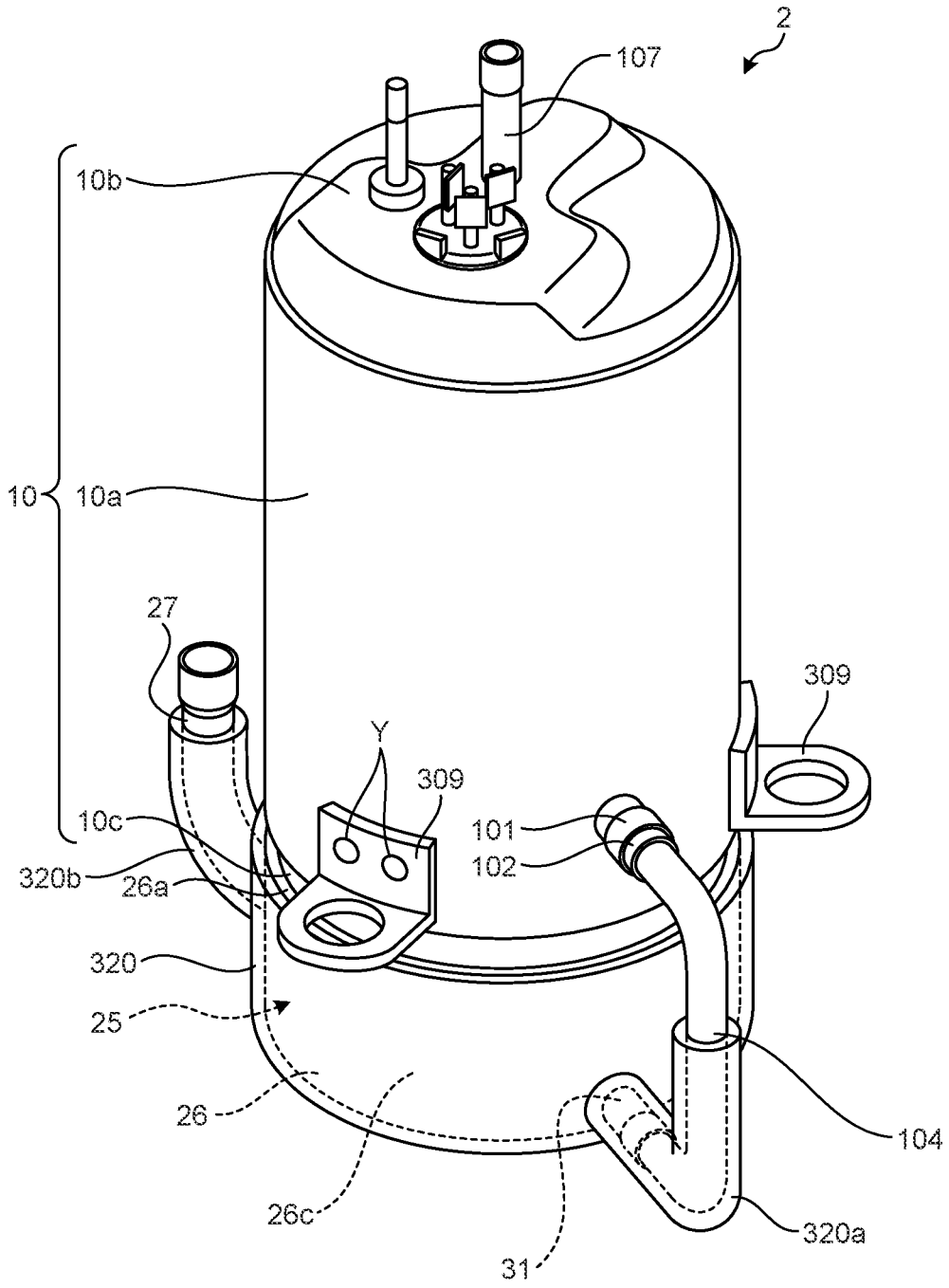
FIG. 6 is a perspective view of a rotary compressor according to a first modification example.
Figure 7:
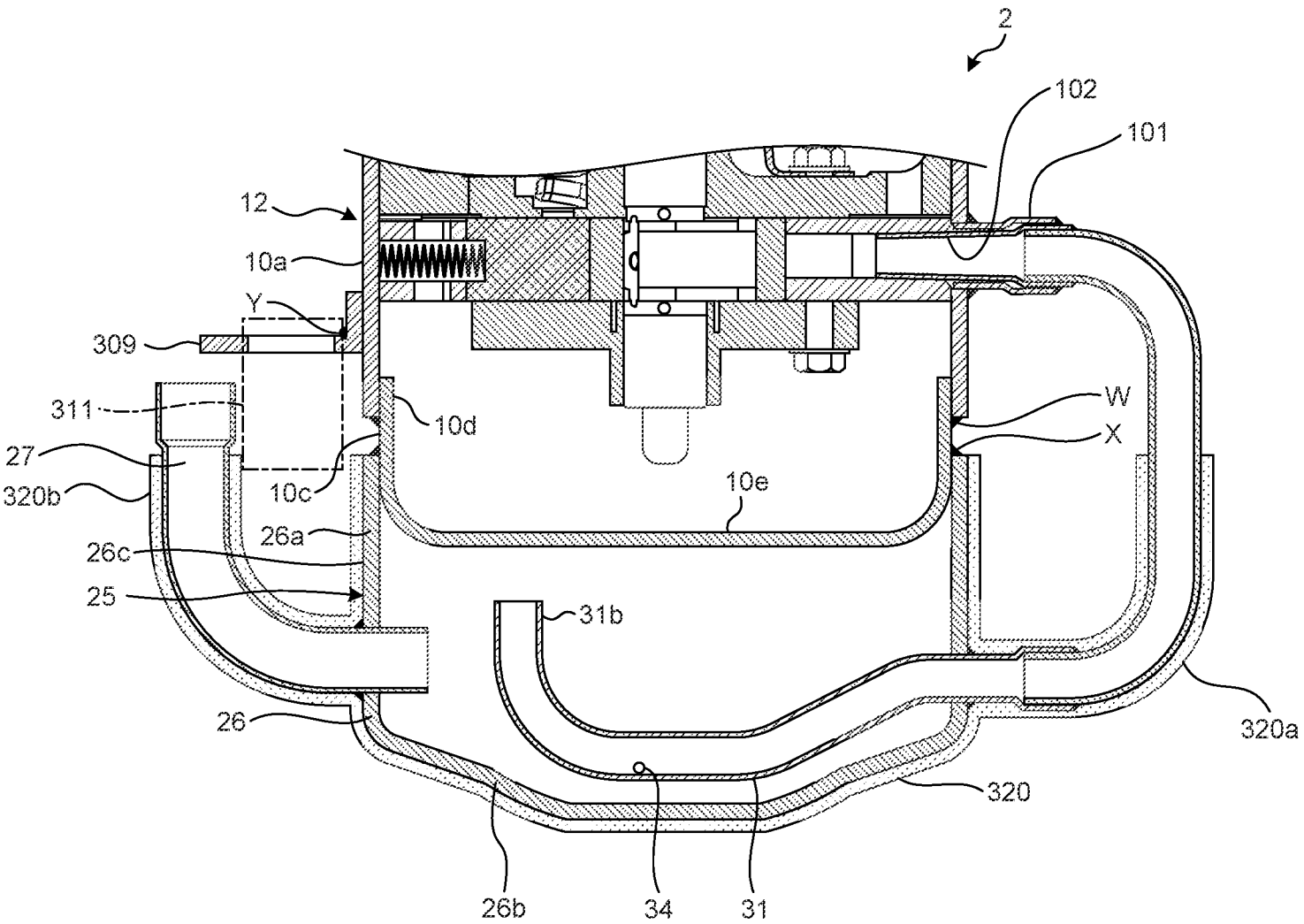
FIG. 7 is a vertical cross-sectional view of the main parts according to the first modification example.

The first modification example differs from the embodiment in the way that a heat insulation member is provided that covers the accumulator container 25. FIG. 6 is a perspective view of a rotary compressor according to the first modification example. FIG. 7 is a vertical cross-sectional view of the main parts according to the first modification example. As illustrated in FIGS. 6 and 7, a rotary compressor 2 according to the first modification example includes a heat insulation member 320 that covers an outer periphery 26*c* of the accumulator shell 26 of the accumulator container 25. Since the heat insulation member 320 covers the outer periphery 26*c* of the accumulator shell 26, the heat transfer between the outer periphery 26*c* and the air surrounding the accumulator container 25, is blocked. Hence, even when the temperature of the outer periphery 26*c* of the accumulator shell 26 becomes low, the heat insulation member 320, which covers the outer periphery 26*c* of the accumulator shell 26, enables holding down a drop in the temperature of the air surrounding the accumulator container 25. As a result, it becomes possible to hold down the formation of frost (ice) around the accumulator container 25.

The heat insulation member 320 is formed in a cup shape that covers the whole circumference of the outer periphery 26*c* from the non-opening side (the bottom face side) 26*b* of the accumulator shell 26. The heat insulation member 320 includes a first pipe portion 320*a* that covers the lower end portion of the connecting pipe 104, that is, covers the connection portion between the connecting pipe 104 and the gas-liquid separation pipe 31, and includes a second pipe portion 320*b* that covers the lower end portion side of the accumulator suction pipe 27. Moreover, in an identical manner to the embodiment, in the first modification example too, the leg members 309, which have the elastic bodies 311 attached thereto, are fixed to the outer periphery of the main shell 10*a*. As a result of having the first pipe portion 320*a*, the heat insulation member 320 prevents the frost, which develops from the accumulator container 25 along the longitudinal direction of the connecting pipe 104, from reaching the leg members 309 and from causing the elastic bodies 311 to freeze. Moreover, the frost, which is generated in the accumulator container 25, or the accumulator suction pipe 27, or the lower end portion of the connecting pipe 104, can be prevented from growing up to the bottom plate 330 of the exterior unit, thereby enabling holding down the generation of abnormal noise or abnormal vibrations accompanying the interference between the frost (ice) and the other components.

Meanwhile, although not illustrated in the drawings, the heat insulation member 320 includes, for example, a notch formed to join the upper end side and the lower end side of the accumulator shell 26; a notch formed in the first pipe portion 320*a* along the longitudinal direction of the connecting pipe 104; and a notch formed in the second pipe portion 320*b* along the longitudinal direction of the accumulator suction pipe 27. The heat insulation member 320 is attached through those notches, and covers the outer side of the accumulator container 25. Moreover, the heat insulation member 320 is fixed to the outer periphery 26*c* of the accumulator shell 26 using an adhesive agent or an adhesive tape.

As a result of providing the heat insulation member 320 as explained above, it becomes possible to hold down the attachment of frost (ice) around the accumulator container 25. Hence, the frost developing in the surrounding of the low-temperature accumulator container 25, can be prevented from getting attached to the elastic bodies 311 of the leg members 309. Since the heat insulation member 320 is disposed to cover at least some portion of the outer periphery 26*c* of the accumulator container 25, it becomes possible to hold down the attachment of ice to the portion, covered by the heat insulation member 320 around the accumulator container 25.

According to the first modification example, the heat insulation member 320 is disposed to cover the accumulator container 25. As a result, as compared to the embodiment, it becomes still more difficult for the leg members 309 to get cooled by the accumulator container 25 inside which the temperature becomes low because of the refrigerant gas. That enables further holding down the freezing of the elastic bodies 311. Consequently, it becomes possible to further hold down a decline in the elasticity of the elastic bodies 311, thereby making it possible to stably absorb the vibrations of the rotary compressor 2 using the elastic bodies 311 and to suppress the vibrations.

Second Modification Example

Figure 8:
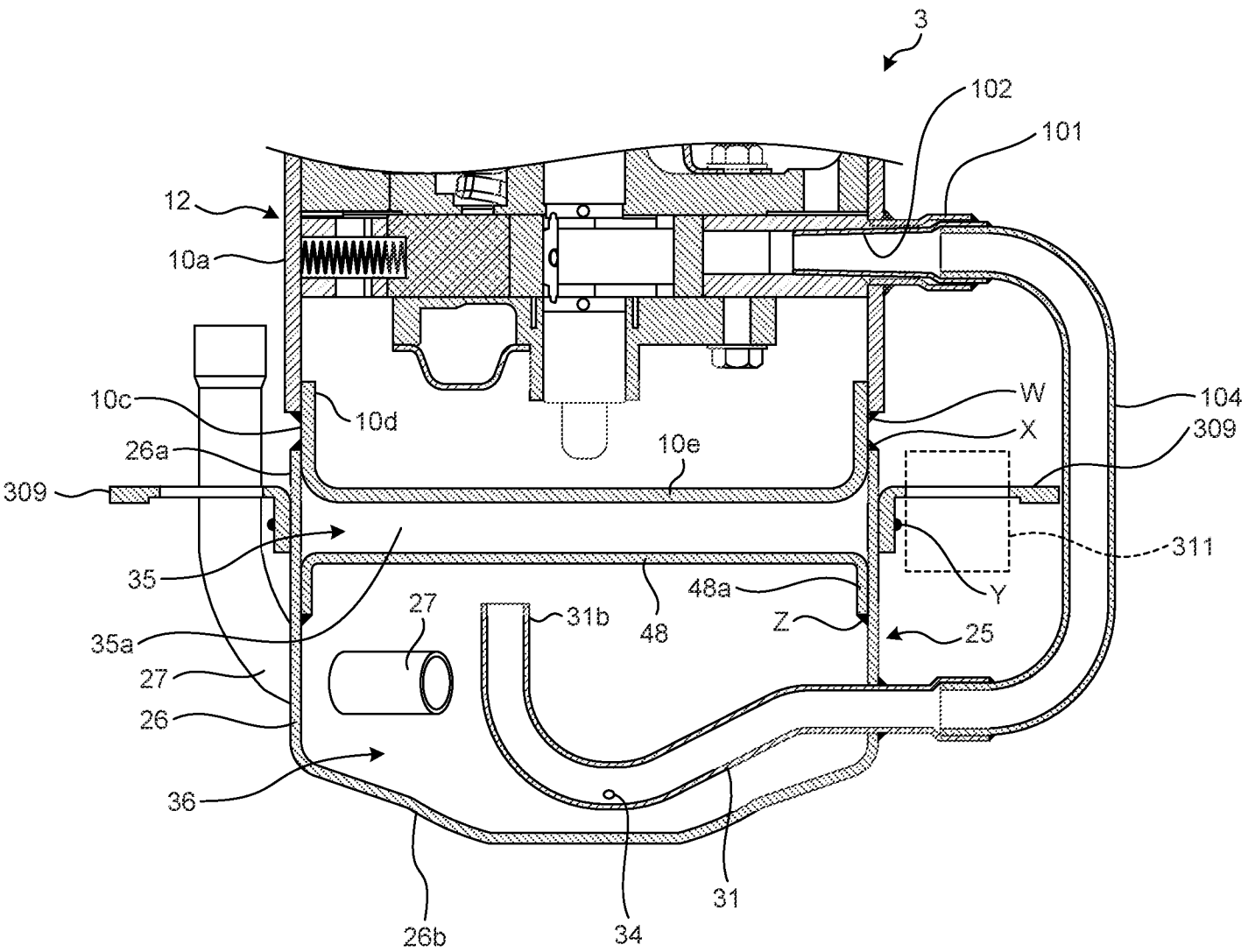
FIG. 8 is a vertical cross-sectional view of the main parts according to a second modification example.

A second modification example differs from the embodiment and the first modification example in the way that a heat insulation portion is provided inside the accumulator container 25. FIG. 8 is a vertical cross-sectional view of the main parts according to the second modification example. As illustrated in FIG. 8, in a rotary compressor 3 according to the second modification example, the accumulator container 25 includes a partitioning member 48, which is connected to the inside of the accumulator shell 26 and which partitions the inside of the accumulator shell 26 into a heat insulation portion 35 and an accumulator portion 36.

The heat insulation portion 35 includes a hollow heat insulation space 35*a*, which blocks the heat transfer between the accumulator container 25 and the leg members 309 and which is formed in between the partitioning member 48 and the bottom shell 10*c* of the compressor main-body container 10. In other words, inside the accumulator container 25, the heat insulation portion 35 is formed in between the accumulator portion 36 and the non-opening side 10*e* of the bottom shell 10*c*.

Of the partitioning member 48, an outer periphery portion 48*a* is bonded to the inner periphery of the accumulator shell 26 using a fifth weld portion Z. The fifth weld portion Z is formed across the circumferential direction of the inner periphery of the accumulator shell 26. Thus, in the accumulator shell 26, the accumulator portion 36, in which the refrigerant is put, is hermetically formed because of the accumulator shell 26 and the partitioning member 48. The outer periphery portion 48*a* of the partitioning member 48 is not limited to have the shape bent toward the lower side of the accumulator shell 26, and alternatively can have the shape bent toward the upper side of the accumulator shell 26. Meanwhile, the fifth weld portion Z can be formed by a plurality of point-like weld portions provided at predetermined intervals in the circumferential direction of the accumulator shell 26.

The leg members 309 are bonded to the positions neighboring the heat insulation portion 35 on the opening side (the upper end side) 26*a* of the outer periphery 26*c* of the accumulator shell 26. Thus, because of the heat insulation portion 35, the elastic bodies 311, which are attached to the leg members 309, are prevented from getting cooled by the low-temperature accumulator portion 36.

Moreover, in each leg member 309, the supporting piece 309*b* is bonded to the opening side 26*a* on the outer periphery 26*c* of the accumulator shell 26 using the fourth weld portion Y, and in the orientation positioned more on the upper side than the fixed piece 309*a*. As a result, the elastic body 311, which is attached to the supporting piece 309*b*, is placed further away from the accumulator container 25, thereby preventing the frost, which is generated around the accumulator container 25, from getting attached to the elastic body 311 through the leg member 309 and thus preventing the elastic body 311 from freezing.

Although not illustrated in FIG. 8, in the second modification example too, the leg members 309 can be bonded to the lower end portion of the outer periphery of the main shell 10*a*, and the situation, in which the elastic bodies 311 get cooled by the accumulator portion 36 of the low-temperature accumulator container 25, can be further prevented from occurring due to the heat insulation portion 35, which is disposed in between the main shell 10*a* and the accumulator portion 36.

According to the second modification example, the heat insulation portion 35 is disposed inside the accumulator container 25, and the leg members 309 are bonded to the positions neighboring the heat insulation portion 35 on the outer periphery 26*c* of the accumulator shell 26. Hence, as compared to the embodiment, it becomes more difficult for the leg members 309 to get cooled by the accumulator portion 36 inside which the temperature becomes low because of the refrigerant gas. Consequently, it becomes possible to further hold down a decline in the elasticity of the elastic bodies 311, thereby making it possible to stably absorb the vibrations of the rotary compressor 3 using the elastic bodies 311 and to suppress the vibrations. Meanwhile, in the second modification example too, in an identical manner to the first modification example, the heat insulation member 320 can be disposed to cover at least some portion of the outer periphery 26*c* of the accumulator container 25, so that it becomes possible to enhance the effect of holding down the freezing of the elastic bodies 311.

Moreover, since the heat insulation space 35*a* of the heat insulation portion 35 is formed in between the compressor main-body container 10 and the accumulator portion 36, mutual heat transfer between the high-temperature compressor main-body container 10 and the low-temperature accumulator portion 36, is prevented from occurring, and the compression efficiency of the rotary compressor 3 can be prevented from declining.

Although not illustrated in the drawings, for example, it is possible to provide a ring-like member that is bonded to the outer periphery of the main shell 10*a* of the compressor main-body container 10 or to the outer periphery 26*c* of the opening side 26*a* of the accumulator shell 26; and the leg members 309 can be bonded to the ring-like member. In that case, the leg members 309 and the ring-like member can be formed in an integrated manner. Moreover, although not illustrated in the drawings, the leg members 309 can be formed using flange portions that are formed by bending the opening side 26*a* of the accumulator shell 26 or by bending the lower end portion of the main shell 10*a* of the compressor main-body container 10.

Meanwhile, the rotary compressor according to the present embodiment is not limited to, what is called, a single-cylinder type rotary compressor that includes only a single cylinder. Alternatively, the rotary compressor according to the present embodiment can also be implemented in, what is called, a two-cylinder type rotary compressor that includes two cylinders. Moreover, in the present embodiment, the explanation is given with reference to a rotary compressor as an example. Alternatively, for example, the present embodiment can also be implemented in some other type of compressor such as a scroll compressor, and it is possible to achieve identical effects to the effects achieved in the present embodiment.

REFERENCE SIGNS LIST

1, 2, 3 rotary compressor
10 compressor main-body container
10*c* bottom shell
11 motor
12 compression section
25 accumulator container
26 accumulator shell
26*a* opening side
26*c* outer periphery
35 heat insulation portion
35*a* heat insulation space
36 accumulator portion
48 partitioning member
102 compression section suction pipe (suction pipe)
107 discharge pipe
309 leg member
309*a* fixed piece (fixed portion)
309*b* supporting piece (supporting portion)
310 base member
311 elastic body
320 heat insulation member

The invention claimed is:

1. A hermetic type compressor comprising:
a compressor main-body container that has a vertically cylindrical shape, and that is provided with a discharge pipe and a suction pipe for a refrigerant;
an accumulator container that is connected to the suction pipe;
a compression section that
is disposed in the compressor main-body container,
compresses the refrigerant sucked from the accumulator container via the suction pipe, and
discharges compressed refrigerant from the discharge pipe; and
a motor that is disposed inside the compressor main-body container, and that drives the compression section, wherein
the accumulator container includes a cup shape accumulator shell that has opening side thereof bonded to the compressor main-body container,
the hermetic type compressor further comprises
a leg member that supports the compressor main-body container and the accumulator container,
an elastic body that supports the leg member, and
a heat insulation member that covers at least some portion of an outer periphery of the accumulator container,
the leg member is bonded to an outer periphery of the compressor main-body container to be fixed away from an area which may be frosted by the refrigerant within the accumulator container, and
the heat insulation member is formed in a cup shape to cover a whole circumference of an outer periphery of the accumulator shell and has an inside surface in contact with the outer periphery of the accumulator shell.

2. A hermetic type compressor comprising:
a compressor main-body container that has a vertically cylindrical shape, and that is provided with a discharge pipe and a suction pipe for a refrigerant;
an accumulator container that is connected to the suction pipe;
a compression section that
is disposed in the compressor main-body container,
compresses the refrigerant sucked from the accumulator container via the suction pipe, and
discharges compressed refrigerant from the discharge pipe; and
a motor that is disposed inside the compressor main-body container, and that drives the compression section, wherein
the accumulator container includes
a cup-shaped accumulator shell that has opening side thereof bonded to the compressor main-body container, and a partitioning member that is bonded to inside of the accumulator shell, and that partitions the inside into a heat insulation portion and an accumulator portion, the heat insulation portion includes a heat insulation space formed in between the partitioning member and the compressor main-body container, a leg member, which supports the compressor main-body container and the accumulator container, is bonded to a position adjacent to the heat insulation space on an outer periphery of the accumulator shell to interpose the accumulator shell between the leg member and the heat insulation space, and is fixed away from an area which may be frosted by the refrigerant within the accumulator container, and an elastic body is attached to the leg member for supporting the leg member.

3. The hermetic type compressor according to claim 2, wherein the outer periphery of the accumulator shell may be frosted by the refrigerant within the accumulator container.

4. The hermetic type compressor according to claim 3, wherein the heat insulation space is formed across an entire cross section within the accumulator shell when viewed from an up-down direction of the compressor main-body container.

5. A hermetic type compressor comprising:

a compressor main-body container that has a vertically cylindrical shape, and that is provided with a discharge pipe and a suction pipe for a refrigerant;

an accumulator container that is connected to the suction pipe;

a compression section that is disposed in the compressor main-body container, compresses the refrigerant sucked from the accumulator container via the suction pipe, and discharges compressed refrigerant from the discharge pipe; and a motor that is disposed inside the compressor main-body container, and that drives the compression section, wherein the accumulator container includes a cup shape accumulator shell that has an opening side thereof bonded to the compressor main-body container, the hermetic type compressor further comprises a leg member that supports the compressor main-body container and the accumulator container, an elastic body that supports the leg member, a gas-liquid separation pipe configured to deliver a gas refrigerant from inside of the accumulator container;

a compressor section suction pipe configured to allow the compression section to suck the gas refrigerant;

a connecting pipe configured to connect the gas-liquid separation pipe and the compressor section suction pipe outside the accumulator container; and a heat insulation member configured to cover at least a part of an outer periphery of the accumulator container, wherein the leg member is bonded to an outer periphery of the compressor main-body container to be fixed away from an area which may be frosted by the refrigerant within the accumulator container, the compressor main-body container includes a cylindrical main shell, and a bottom shell that is bonded to lower end of the main shell, the bottom shell of the compressor main-body container is inserted into the opening side of the accumulator shell, the opening side of the accumulator shell is bonded to the bottom shell of the compressor main-body container, the heat insulation member has a first pipe portion that covers at least a connection portion between the gas-liquid separation pipe and the connecting pipe, and the first pipe portion is formed to be in contact with the outer periphery of the gas-liquid separation pipe and the outer periphery of the connecting pipe.

6. The hermetic type compressor according to claim 5, wherein the first pipe portion is provided away from the compressor section suction pipe.

* * * * *